United States Patent [19]

Fonda-Bonardi

[11] 4,029,430

[45] June 14, 1977

[54] SHORT SUBSONIC DIFFUSER FOR LARGE PRESSURE RATIOS

[76] Inventor: Giusto Fonda-Bonardi, 2075 Linda Flora Drive, Los Angeles, Calif. 90024

[22] Filed: Sept. 2, 1975

[21] Appl. No.: 609,439

[52] U.S. Cl. ..... 415/53 R; 415/DIG. 1; 417/87

[51] Int. Cl.[2] ..... F01D 1/12

[58] Field of Search ..... 415/209, DIG. 1, 53; 60/269, 39.52, 645; 417/151, 87

[56] References Cited

UNITED STATES PATENTS

| | | | |
|---|---|---|---|
| 1,375,601 | 4/1921 | Morize | 60/269 |
| 2,000,741 | 5/1935 | Buckland | 415/DIG. 1 |
| 2,410,769 | 11/1946 | Baumann | 415/53 |
| 2,418,801 | 4/1947 | Baumann | 415/53 |
| 2,808,197 | 10/1957 | Forgo | 415/DIG. 1 |
| 2,819,675 | 1/1958 | Gilman | 415/53 |
| 2,892,582 | 6/1959 | O'Rourke | 415/DIG. 1 |
| 2,948,148 | 8/1960 | Anfreville et al. | 415/DIG. 1 |
| 3,123,285 | 3/1964 | Lee | 415/DIG. 1 |
| 3,599,431 | 8/1971 | Bonardi | 60/645 |
| 3,782,111 | 1/1974 | Kotoc | 60/269 |

FOREIGN PATENTS OR APPLICATIONS

| | | | |
|---|---|---|---|
| 167,774 | 2/1951 | Austria | 60/269 |
| 834,474 | 4/1952 | Germany | 415/209 |
| 478,097 | 2/1953 | Italy | 60/269 |
| 130,959 | 2/1951 | Sweden | 60/269 |
| 652,749 | 5/1951 | United Kingdom | 415/53 |
| 141,488 | 4/1961 | U.S.S.R. | 415/DIG. 1 |

*Primary Examiner*—Henry F. Raduazo

*Attorney, Agent, or Firm*—Blakely, Sokoloff, Taylor & Zafman

[57] ABSTRACT

A short, wide angle diffuser having means for preventing boundary layer separation is disclosed. The means includes means for injecting a fluid stream into the diffuser at preselected locations for mixing with the boundary layer fluid. The injected fluid may be derived from the fluid exiting from the diffuser and fed back into the diffuser.

10 Claims, 5 Drawing Figures

SHORT SUBSONIC DIFFUSER FOR LARGE PRESSURE RATIOS

CROSS REFERENCES TO RELATED APPLICATIONS

This invention is an improvement over my teachings relative to fluid dynamic engines disclosed in my U.S. Pat. Nos. 3,564,850 and 3,599,431.

SUMMARY OF THE INVENTION

This invention relates to a class of devices for the transformation of part of the kinetic energy of a moving fluid into pressure of the fluid. These devices, commonly known as diffusers, rely for their operation on the shape of the solid walls which confine the fluid flow, and do not involve the use of moving parts. Diffusers of this kind are used in many instances of great practical interest, for example, in the body of ejectors and at the outlet of centrifugal pumps. It is generally found that the injected fluid in an ejector or the impeller of a centrifugal pump can efficiently deliver large amounts of kinetic energy to the pumped fluid, which then acquires a high velocity; when the ejector or the pump is required to deliver a large pressure increment rather than a high velocity fluid stream, said high velocity must be reduced in a diffuser, and the corresponding amount of kinetic energy made available by the reduction of velocity must be transformed into pressure of the fluid.

Another example of the use of a diffuser is described in U.S. Pat. No. 3,599,431. In this case the diffuser must slow down a fluid such as a compressible gas, moving at a speed near the speed of sound in said gas when entering the diffuser, and must develop a static pressure near the stagnation pressure of said gas at the outlet of the diffuser. The pressure ratio corresponding to a change of Mach number from $M = 1$ to $M = 0.1$, or less, is almost equal (within a few percent) to the critical pressure ratio of the compressible fluid, and such high ratio is beyond the capabilities of most conventional diffusers. Since the application of the diffuser to pumps and similar devices is obvious and straightforward, the diffuser hereinafter described is discussed with specific reference to the device of U.S. Pat. No. 3,599,431 for definiteness, without any explicit or implied limitation as to the applicability of the diffuser to any other devices whatsoever involving the transformation of the kinetic energy of a moving fluid into pressure.

The desired transformation of kinetic energy into pressure occurs when the fluid moves (subsonically) in a duct having a cross-sectional area increasing in the direction of the motion. In its simplest embodiment the diffuser is a conically divergent duct, and such conical diffusers are well known and in wide use. The conical diffuser is, however, subject to severe limitations in the maximum pressure ratio it can handle.

The principal and major limitation derives from the detachment of the boundary layer in the adverse pressure gradient prevailing along the wall of the diffuser as discussed in my U.S. Pat. No. 3,599,431 in column 2, lines 18 et seq. If an attempt is made to prevent said detachment by reducing the pressure gradient, a very long diffuser is obtained (hence the rule of thumb that the included conical angle must be small, typically 5° to 7°). A very long conical diffuser with a small included angle can, indeed, avoid detachment of the boundary layer, but only at the cost of losing a considerable portion of the initially available kinetic energy to the walls by friction. Consequently, the net efficiency of a well designed conical diffuser rarely exceeds 80% and almost never exceeds 90%.

The device described in U.S. Pat. No. 3,599,431 requires a pressure recovery efficiency of 97% or better for effective operation, hence it cannot use conventional diffusers; in addition, the geometry of the turbine coupling precludes the use of a conical diffuser, and requires the use of a diffuser as described in said patent and specifically covered by claim 9 thereof. This diffuser, because of its shortness, has minimal frictional losses, and therefore can achieve the desired pressure recovery efficiency; however, because of its very shortness, of necessity develops large pressure gradients along its walls and therefore is prone to boundary layer detachment.

Accordingly, the present invention describes a physically short diffuser capable of achieving high pressure ratios, being free of the limitations caused by the detachment of the boundary layer in the adverse pressure gradient of the diffuser. Another objective of this invention is a short, wide-angle diffuser capable of providing a pressure recovery efficiency in excess of 95%.

These and other features of the invention can be more fully appreciated through reference to the drawings forming part of this specification, wherein.

Figure 3:
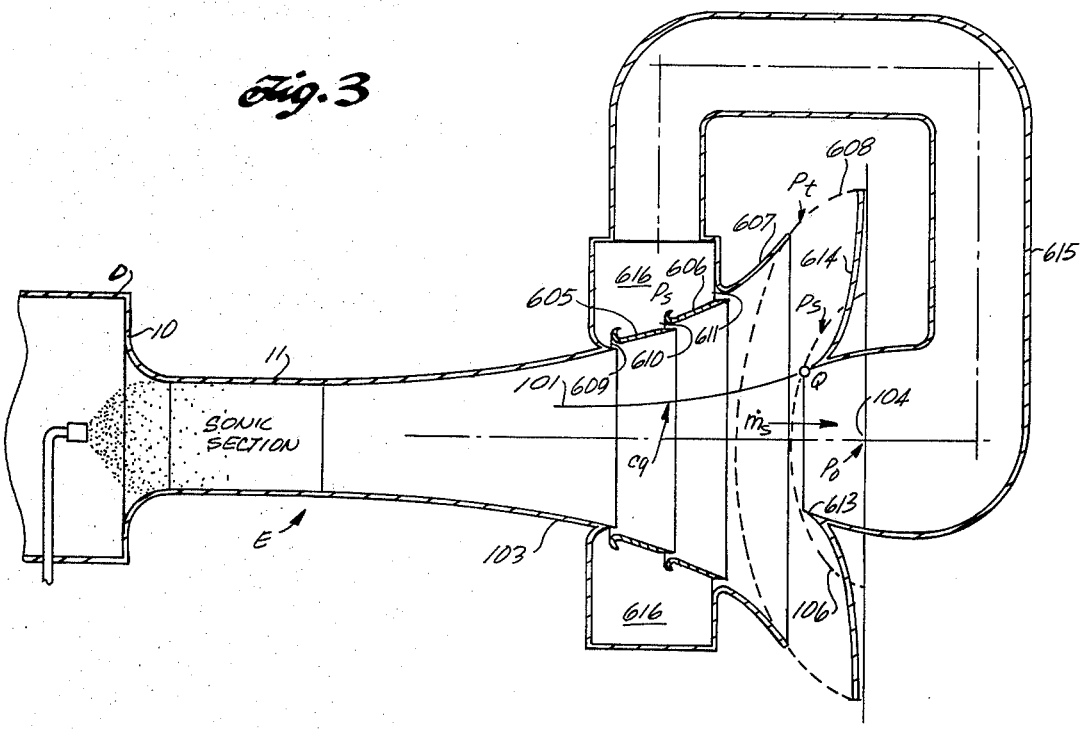
FIG. 3 shows a cross-section of a diffuser embodying the present invention.
Figure 4:
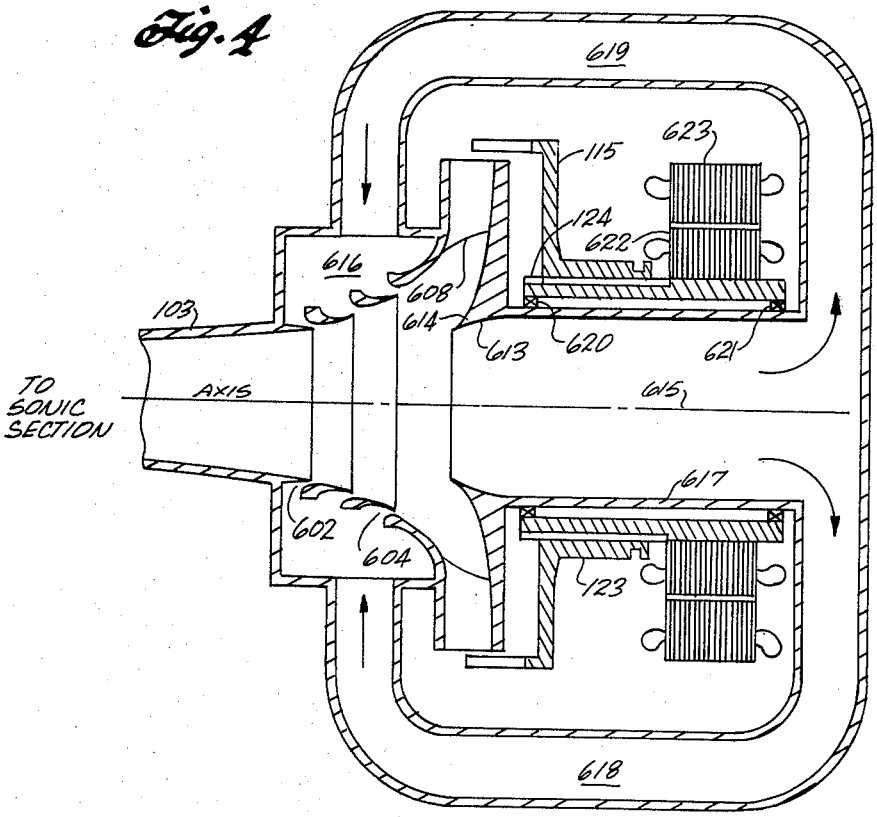
Figure 5:
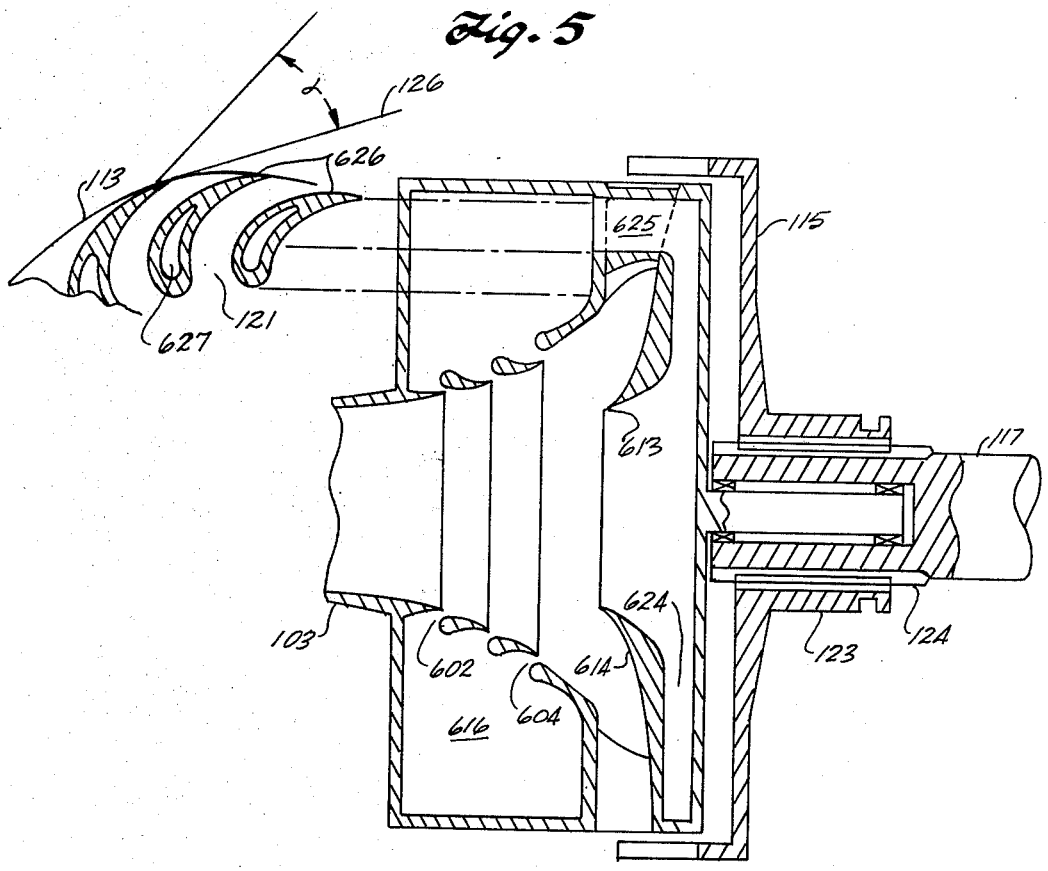

FIG. 4 is a partial, sectional view of the diffuser of FIG. 3 applied to the device described in my U.S. Pat. No. 3,599,431; and FIG. 5 is a partial, sectional view of the device of FIG. 4.

This invention is based on my teachings of a fluid-dynamic engine or transformation of the kinetic energy of a moving fluid into pressure of the fluid as disclosed and claimed in my U.S. Pat. Nos. 3,564,850 and 3,599,431 and which disclosures are incorporated herein by reference.

Figure 1:
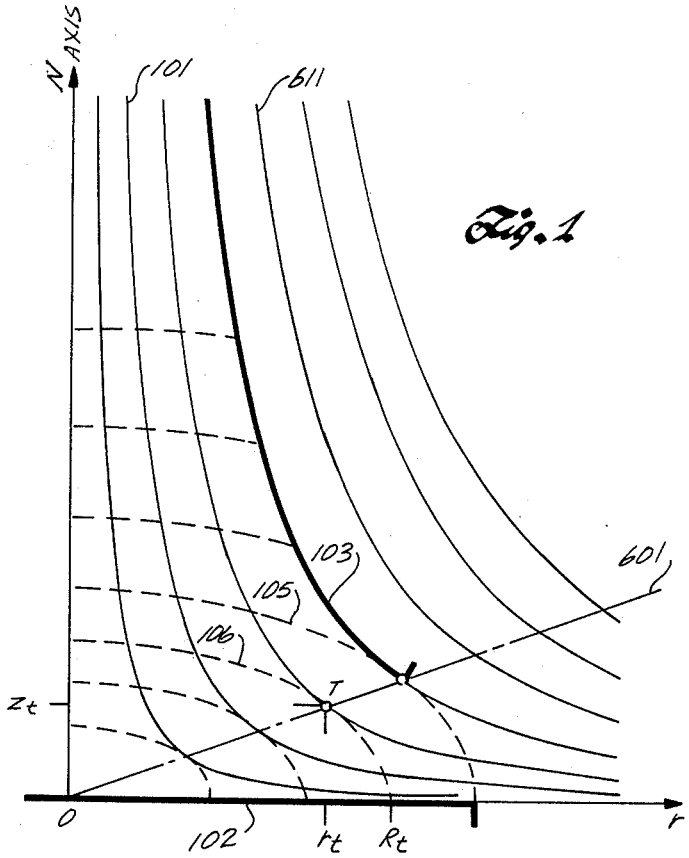
FIG. 1 is a diagrammatic graphical representation of the streamlines and equal-pressure isobaric lines in the diffuser of the type of the present invention.

The diffuser discussed in my U.S. Pat. No. 3,599,431 is characterized by an axially symmetrical flow, wherein each stream tube intersects any plane passing through the axis, meridian plane, in a curved line which is a cubic hyperbola described by the equation $$z\,r^2 = c \tag{1}$$

wherein $z$ is the distance from the end plate, $r$ is the radius and $c$ is a constant. The surfaces of constant pressure, the isobaric surfaces, are oblated ellipsoids which intersect all meridian planes along elliptical curves described by the equation disclosed for example, by L. Prandtl and O. G. Tietjens, in the text entitled "Fundamentals of Hydro- and Aeromechanics", Dover, N.Y. 1957 on page 144 as follows:

$$4\,z^2 + r^2 = R_t^2 \tag{2}$$

where $R_t$ is the radius where the ellipsoid intersects the end plate ($z = 0$), as illustrated in FIG. 1 hereof, which shows several streamlines 101 and 611, several isobaric lines 105, 106, the end plate 102 located at $z = 0$, and the sidewall 103 of the diffuser, coincident in shape and position with a preselected streamline of the family, as discussed in detail in U.S. Pat. No. 3,599,431, column 2, lines 67 et seq. To show the relationship with the prior disclosure, the same reference numbers are used herein, where applicable, to identify the same elements identified by the same reference numbers in my said patent.

In order to compute the static pressure existing at each point of the wall, and thereby the pressure gradient which determines the tendency of the boundary layer to detach from the wall, it is necessary to compute the effective cross-sectional area of the diffuser corresponding to that point on the wall. It is also important to find the point on each streamline at which the highest static pressure occurs, since this point is used in the detailed design of the diffuser, as will be explained in detail hereinafter.

As a fluid element moves along a streamline the pressure at first increases, and then decreases, while the velocity of course first decreases and then increases. The point of maximum pressure occurs where the streamline is tangent to an isobaric line, such as point T in FIG. 1. This point is found by differentiating equations (1) and (2) and equating the two derivatives:

$$-\sqrt{c}/2z^{3/2} = -4z/r$$

and therefore $$c = 64z^5/r^2$$

which, substituted in equation (1), gives:

$$z_t = r/\sqrt{8} = (c/8)^{1/3} \quad (3)$$

where $z_t$ and $r_t$ are the coordinates of the point T of maximum pressure on that streamline. All such points lie on a straight line passing through the origin and forming an angle arctan $\sqrt{8}$ with the axis, as shown by the dashed line 601 in FIG. 1. The major semiaxis of the isobaric ellipse passing through T is found by substituting $z_t$ and $r_t$ in equation (2)

$$R_t = r_t\sqrt{3/2}. \quad (4)$$

The pressure pertaining to a particular isobaric ellipse intersecting the wall of the diffuser can be easily computed if the effective area of the diffuser is known as a function of the coordinates of a point on the wall. By integration of the flow over a surface of constant velocity it is found that the effective area A corresponding to a point $r,z$ on the wall is $$A = \pi(2zR - 8z^3/R)$$

The effective terminal area of the diffuser, or the effective area crossed by the flow at the point of maximum pressure on a streamline, is found by substituting in this expression the coordinates of the point of maximum pressure on the streamline, in particular the streamline coincident with the wall of the diffuser:

$$A_t = \pi r_t^2/\sqrt{3} = 2\pi c^{2/3}/\sqrt{3} \quad (5)$$

It is not possible nor proper to present here a complete and detailed discussion of the relationship between pressure gradient and boundary layer growth and eventual separation. Only a few significant equations will be presented such as have a direct bearing on the design procedures for the diffuser.

The growth and detachment of a turbulent boundary layer are in one-to-one correspondence with the variation of a specific parameter, called the form factor H. In particular, a turbulent boundary layer in zero pressure gradient is characterized by a value of this parameter H = 1.4; the boundary layer becomes detached when an adverse pressure gradient causes this parameter to grow to a value H = 1.8. The variation of H is described by the following differential equation in the text by H. Schlichting, entitled "Boundary Layer Theory," published by McGraw-Hill, New York 1960, on page 571 as follows:

$$\frac{dH}{dx} = \left[-\frac{1}{u}\frac{du}{dx} - C_f(H-1.4)\frac{H}{\delta}\left(\frac{Hx}{\delta}\right)^{1/6}\right]\exp 5(H-1.4) \quad (6)$$

where $u$ is the free stream velocity, $x$ is the length along the wall, $C_f$ the friction coefficient.

Equation (6) contains two terms in the bracket. They represent the effects of two distinct mechanisms. The term $-(l/u)\ du/dx$ describes the loss of longitudinal momentum due to the adverse pressure gradient acting to reduce the free stream velocity $u$; the other term represents the effect of momentum transport from the core flow towards the wall: as such it is proportional to $C_f$ which is indeed a measure of the momentum delivered to the wall. The momentum derived from the core flow counteracts to some extent the momentum lost by the effect of the pressure gradient.

If one wishes to keep the boundary layer from detaching, one must prevent H from increasing beyond 1.8. Therefore at some point before the point where H becomes equal to 1.8 one must intervene in some way. In the case of a conventional conical diffuser this intervention is done by assigning such a length to the diffuser that the pressure gradient and therefore $du/dx$ are so small compared with the second term in the bracket of equation (6) that $dH/dx$ becomes effectively equal to zero, and H stops growing. In this case the rate of momentum transfer from the core flow to the boundary layer just balances the momentum loss due to the adverse pressure gradient; but since the momentum subtracted from the core flow is lost to the purposes of pressure recovery, the efficiency of the conical diffuser is correspondingly low.

The opposite is true in the case here considered. The diffuser can be made so short and the pressure gradient is therefore necessarily so high that the second term in the bracket of equation (6) becomes entirely negligible in comparison with $du/dx$, and equation (6) can be simplified to:

$$\frac{dH}{dx} = -\frac{l}{u}\exp 5(H-1.4)\frac{du}{dx} \quad (7)$$

which can be integrated directly between the limits $H = 1.4$ and $H = 1.8$, with the result that:

$$u_{1.8}/u_{1.4} = 0.842$$

where $u_{1.4}$ is the value of the core velocity where $H = 1.4$, and $u_{1.8}$ is the value of the velocity where $H = 1.8$. This means that the boundary layer detaches when the adjacent core velocity is decreased to 0.842 of the value it had where H was equal to 1.4, and some intervention must be made at this point to prevent detachment.

The preferred intervention in accordance with the teachings of this disclosure consists of blowing a thin sheet of high velocity fluid into the boundary layer through a slot tangential to the wall. The fluid is supplied to the slot with a pressure $p_s$ initially higher than the static pressure $p$ prevailing in the diffuser at that point, and hence it is accelerated through the pressure drop $p_s - p$; since the pressure gradient upstream of the slot is favorable for the accelerated fluid, the boundary layer in contact with the wall of the slot starts off with a value of $H = 1.4$, and this new boundary layer remains attached until the fluid velocity is decreased to 0.842 of the value it had at the injection point. Here the process may be repeated.

Figure 2:
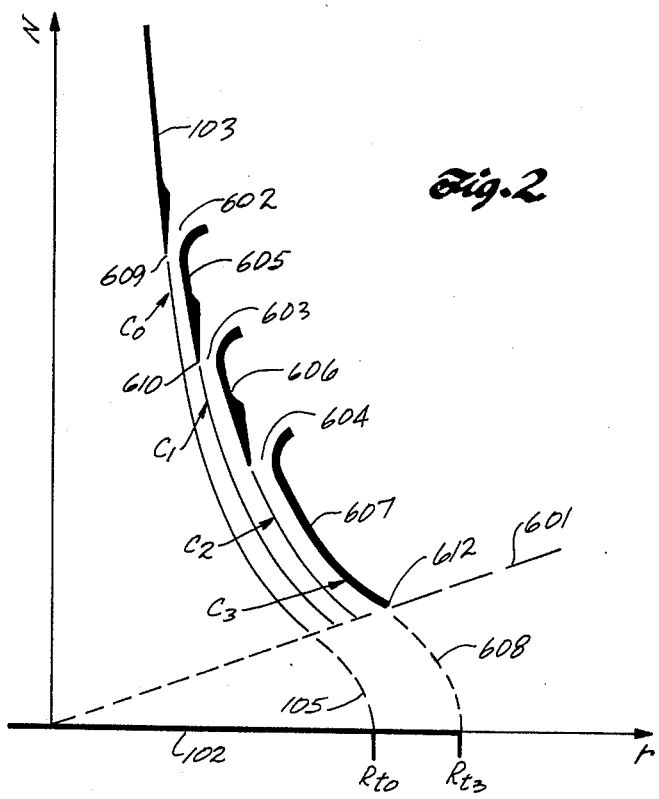
FIG. 2 is a diagrammatic graphical cross-section of a diffuser showing the relationship between streamlines and wall slots.

The diffuser of the present invention, then, is equipped with a series of $n$ slots, as illustrated in FIG. 2, where the number of slots $n$ is equal to 3 for illustrative purposes. The $n$ slots are located at the point where the fluid velocities have values in a geometrical series as folllows:

$$u_0 : u_1 : u_2 : \ldots : u_n = 1 : q : q^2 : \ldots : q^n$$

where $q$ is the velocity ratio for detachment, $q = 0.842$. The width of each slot is made as small as practical consistent with the requirement that it be adequate to accelerate by turbulent mixing the slow fluid contained in the boundary layer at that point. Thus, with reference to FIG. 2, the original diffuser wall 103 is made to terminate in a sharp trailing edge 609 adjacent to a first slot 602; this is located at the point where the core velocity is equal to $q$ times the inlet velocity to the diffuser. The outer wall 605 of slot 602 is made in turn to terminate in a sharp trailing edge 610 adjacent to a second slot 603, located where the fluid velocity is equal to $q$ times the velocity at slot 602, and equal to $q^2$ times the inlet velocity to the diffuser. The process is repeated with regard to outer wall 606 and a third slot 604; when no more slots are needed, the outer wall 607 of the last slot is carried to the terminal edge of the diffuser.

The total number $n$ of slots to be used in any design is determined by the velocity ratio, being a function of the pressure ratio, from the inlet to the terminal outlet of the diffuser. In particular, from equation (8) we have $$n \geqslant \log q / (\log u_o - \log u_t)$$

where $u_t$ is the velocity at the outlet.

The profiles of the segments of wall 605, 606, 607, and subsequent segments if more are needed to satisfy the total velocity ratio, are made to coincide with typical streamlines of the family used in the design of the diffuser, in particular streamlines external to the original wall of the diffuser, such as streamline 611 in FIG. 1. The profiles are computed by assigning appropriate values $c_1, c_2, c_3, \ldots c_n$ to constant $c$ in Equation (1), $c_0$ being the value pertaining to the initial wall 103 of the diffuser. The corresponding streamlines are shown in their extension in FIG. 2, and are labeled with symbols $c_0$, $c_1$,$c_2$ and $c_3$. The last wall segment 607 is made to terminate at point 612 where the corresponding streamline defined by constant $c_n$, in the case illustrated $n = 3$ or $C_3$, is tangent to the isobaric ellipse 608, that is where both the streamline and the isobaric ellipse are intersected by straight line 601, passing through the origin, and forming an angle arctan $\sqrt{8}$ with the axis. The endplate 102 is extended from the original radius $R_{to}$ to a new radius $R_{t3}$ equal to the major semiaxis of ellipse 608.

The geometry discussed hereinabove requires in practice three minor, but not negligible, structural refinements to operate properly.

The first refinement involves the alteration of the profile between the slots to accommodate the displacement thickness of the boundary layer, so as to retain a core flow closely approximating the theoretical flow pattern of an axially symmetrical jet impinging on a flat plate; this alteration of the profile is exactly analogous to the one already discussed in U.S. Pat. No. 3,599,431.

The second refinement involves the detailed design of the slot shape and of the walls in the neighborhood of the slots. The turbulent mixing of the slot flow with the boundary layer flow occurs in a region of strong adverse pressure gradient, and the wall curvature in the meridian plane introduces centrifugal and Coriolis forces which also affect the mixing process. For these reasons the problem of designing a satisfactory transition geometry is not a trivial one, and can best be solved by the use of a digital computer for integrating the detailed differential equations which describe the turbulent mixing of the fluids and the growth of the boundary layer.

The third refinement is conceptually simple but leads to a substantial modification of the shape and function of end plate 102. This is due to the fact that the pressure $p_s$ of the fluid feeding the slots must be higher than the terminal pressure $p_t$ existing on isobaric surface 608, to prevent detachment of the boundary layer from the last segment of wall 607 between last slot 604 and terminal point 612. It would seem therefore that a pump would be required to compress said fluid feeding the slots to said pressure $p_s$ higher than $p_t$; it is however possible to dispense with the cost and complication of a pump, and to retain the desirable feature of having no mechanically moving parts, by taking advantage of the fluid flow in the diffuser itself.

If the number $n$ of the slots and their dimensions are appropriately chosen, the total mass flow $m_s$ through the slots may be kept equal to a relatively small fraction (typically 10 to 20 percent) of the mass flow in the diffuser, and the slot supply pressure $p_s$ can be chosen to be higher than terminal pressure $p_t$, but lower than the stagnation pressure $p_o$ of the moving fluid in the diffuser. Then if $$p_t < p_s < p_o$$

there exists one isobaric ellipse 106 within the bell of the diffuser, located somewhere between the terminal ellipse 105 (see FIG. 2) and central point 104 (FIG. 3) on which the pressure is $p_s$ or higher, as shown in FIG. 3.

Also, if the total mass flow $m_s$ *pf* the fluid passing through the slots is known, it is possible to find a streamtube defined by a streamline 101 (FIG. 1) such that the mass flow in said streamtube is equal to $m_s$. Since the mass flow in any streamtube is proportional to the numerical value of constant $c$ in equation (1), the appropriate value of constant $c_q$ defining said streamline 101 is simply the difference $$c_q = c_n - c_o \tag{7}$$

of the corresponding constants for the streamlines defining respectively the last wall segment and the original wall of the diffuser, since the total mass flow through the slots is contained in the annular space between the corresponding streamtubes, and therefore it is equal to the difference of the mass flows pertaining to them.

The streamline 101 defined by constant $c_q$ and isobaric ellipse 106 intersect at a point Q as illustrated in FIG. 3, having the property that the mass flow, crossing an axially symmetrical circle passing through Q, is equal to the mass flow $m_s$ required by the slots, and has a static pressure equal to or higher than $p_s$. Therefore the lip of a scoop 613 can be located at or near said circle passing through point Q. The outer surface 614 of said scoop is made to coincide in shape and position with the continuation of streamline 101 characterized by a constant $c_q$ in equation (1), where the value of $c_q$ is given by equation (7). In particular, since it is desirable to provide a supply pressure as high as possible in order safely to overcome frictional losses in the ducts and in the slots, it is desirable to choose the particular isobaric ellipse 106 in such a way as to make the corresponding pressure not only higher than $p_s$, but also equal to the highest pressure available along streamline 101; this places the preferred position of point Q in coincidence with the position of point T in FIG. 1, that is at the intersection of streamline 102 with the locus of all points of maximum pressure, which is the straight line 610 forming an angle arctan $\sqrt{8}$ with the axis.

The mass flow $m_s$ collected by scoop 613 is carried by a duct 615 to a plenum chamber 616 surrounding the slots; duct 615 must be of such a diameter that the pressure loss due to the friction of the fluid moving through it be acceptably small. FIG. 3 shows in cross-section an embodiment of this invention which may be used directly as shown on the outlet of, for example, a centrifugal pump, wherein wall 103 would be connected to the scroll of the pump, and wherein the delivery of the fluid from terminal surface 608 would be made to destination.

The diffuser can also be easily adapted for service in the device of U.S. Pat. No. 3,599,431 as cross-sectionally shown in FIG. 4, where duct 103 connects with the sonic section of the device described in said patent. End plate 102 of said patent is modified to provide a surface 614 coincident with a suitable preselected streamline of the flow, so as to realize the prescribed mass flow collection and the prescribed relationship between the stagnation pressure $p_o$, the pressure $p$ in scoop 613, the slot supply pressure $p_s$ in plenum chamber 616 surrounding the slots, and the terminal pressure $p_t$ on the terminal isobaric ellipsoidal surface 608 of the diffuser.

The only additional modification of the device described in U.S. Pat. No. 3,599,431 is the enlargement of the diameter of spline elements 123 and 124; see FIG. 1 of U.S. Pat. No. 3,599,431, whereby the supporting shaft 617 can be made hollow and can therefore accommodate and contain duct 615 connected with scoop 613 for collecting the high pressure fluid and conveying it to plenum chamber 616 and slots 602–604. Outside of the supporting structure 617, the fluid is conveyed by one duct, or preferably by a plurality of such ducts 618 and 619, symmetrically located around the device. The use of several return tubes rather than one is beneficial by decreasing the frictional pressure drop of the fluid moving in the ducts, and by creating a more rigid and symmetrical supporting structure for the turbine bearings 620 and 621.

In this case, the path of shaft 117 (shown in U.S. Pat. No. 3,599,431) is obstructed by the ducts 618 and 619, and alternate means must be used to extract the mechanical power developed by turbine wheel 115, such as belts or gears (not shown). If, however, the device is used for generating electrical power as discussed in my U.S. Pat. No. 3,620,017, the electric generator comprising a rotor 622 and a stator 623, can have a hollow shaft and can be mounted directly behind spline element 124 on the same supporting structure 617 comprising return duct 615, as shown in FIG. 4.

FIG. 5 shows a modification of this arrangement for the case in which provisions must be made for shaft 117 to be retained, if the use of belts or gears is not suited to the particular application. In this case, scoop 613 is made to communicate with the enclosed space 624 contained between the modified end plate 614 and the turbine wheel 115. Enclosed space 624 communicates in turn with plenum chamber 616 by means of a plurality of hollow ducts 625, which are so shaped as to perform the function of vanes 120 in U.S. Pat. No. 3,599,431. In other words, said vanes 120 are made to assume the shape of thick airfoils, as shown in the frontal projection 626 of FIG. 5, having their trailing edges still forming in exit angle $\alpha$ with the tangent 126 to cylindrical surfaces 113, and the channels 121 between them still providing an almost constant area path for the fluid, as discussed in said patent. However, in this case, the thickness of each airfoil vane profile 626 is used to provide an axial hollow channel 625 communicating between said space 624 and said plenum chamber 616, sufficient for the transfer of the fluid from scoop 613 to slots 602–604. The total aggregate open area of all hollow channels 625 must be adequate to insure a sufficiently small pressure drop between space 624 and plenum chamber 616, such as not to interfere with the proper performance of slots 602–604.

What is claimed is:

1. In a longitudinal divergent fluid diffuser, comprising means for converting a portion of the kinetic energy of a high velocity moving fluid in said diffuser into a higher pressure upon deceleration of the fluid stream wherein the diffuser includes means for preventing boundary layer detachment of the moving fluid along the divergent wall of the diffuser by increasing the momentum of the boundary layer in a direction parallel to the direction of longitudinal fluid flow by injecting a continuous thin layer of fluid along the diffuser wall through a slot immediately upstream of each point where the boundary layer detachment is likely to occur, means for collecting a central core portion of the high pressure decelerated fluid stream flowing in the diffuser in a central core region, away from the disturbed fluid flow near the diffuser wall, where the stagnation pressure has a value higher than the terminal pressure at the outlet of the diffuser and means for feeding back the collected high pressure central core portion fluid to said means for preventing boundary layer detachment, and means for introducing a high velocity fluid with said kinetic energy to be converted into the diffuser.

2. In a fluid diffuser as defined in claim 1 wherein the means for preventing boundary layer detachment comprises a plurality of fluid injection slots spaced longitudinally along the diffuser at the points immediately upstream of the points where boundary layer detachment would otherwise occur for injecting a fluid stream into the diffuser at points wherein the boundary layer is about to be detached, the number of slots, $n$, being a function of the fluid velocity ratio from the inlet to the terminal outlet of the diffuser.

3. In a longitudinal divergent fluid diffuser as defined in claim 1 wherein the longitudinal divergent wall is a conical wall.

4. In a longitudinal divergent fluid diffuser as defined in claim 2 wherein the fluid injection slots comprise a group of circumferentially spaced slots.

5. In a longitudinal divergant fluid duct as defined in claim 1 including means adjacent the central portion of said fluid duct and cooperating therewith to define a diffuser outlet therebetween.

6. In a longitudinal divergent fluid duct as defined in claim 2 wherein the fluid injection slots are arranged at predetermined positions longitudinally spaced on said fluid duct so that the velocity ration of fluid flowing through said diffuser at adjacent ones of said predetermined positions will not exceed 0.842.

7. In a longitudinal divergent fluid duct as defined in claim 2 wherein the duct wall is displaced outwardly between said fluid injection slots to accommodate the incremental thickness of the fluid injected at each injection point.

8. In a longitudinal divergent fluid duct as defined in claim 2 wherein the upstream duct wall sections adjacent a fluid slot is constructed and defined with a sharp trailing edge for introducing a thin sheet of fluid tangential to the duct wall and into the boundary layer fluid.

9. In a longitudinal divergent fluid duct as defined in claim 1 including means for deriving power from the fluid stream at said outlet.

10. A method for transforming a portion of the kinetic energy of a moving fluid into fluid pressure comprising the steps of providing a longitudinally divergent wall duct having a relatively wide angle diverging wall adjacent the fluid outlet of the duct for confining the high velocity moving fluid and converting a portion of the kinetic energy of the high velocity moving fluid in said duct to pressure by deceleration of the fluid stream in the duct, the angle of the divergent wall being selected for minimizing frictional losses and developing large pressure gradients along the wall thereby rendering it prone to boundary layer detachment, collecting a central core portion of the fluid in the duct in a region having a stagnation pressure exceeding the pressure at the fluid outlet, and introducing the collected core portion of the fluid at a plurality of longitudinally preselected and spaced apart locations along the diverging wall of the duct and in the direction of the moving fluid for mixing with the moving fluid as it moves therethrough for increasing the momentum of the boundary layer against the prevailing pressure gradient in the duct, each of said locations being selected in relationship to the other points whereby the boundary layer would otherwise tend to detach for preventing the detachment of the fluid boundary layer from the duct walls as it moves through the duct.

* * * * *